US006513995B1

(12) United States Patent
Fyson et al.

(10) Patent No.: US 6,513,995 B1
(45) Date of Patent: Feb. 4, 2003

(54) METHOD OF PROCESSING PHOTOGRAPHIC MATERIAL

(75) Inventors: John R. Fyson, Tortworth (GB); Gareth B. Evans, Potten End (GB); Peter Hewitson, Uxbridge (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/164,066

(22) Filed: Jun. 5, 2002

(30) Foreign Application Priority Data

Jun. 13, 2001 (GB) ..... 0114359

(51) Int. Cl.[7] ..... G03D 13/00
(52) U.S. Cl. ..... 396/567; 396/569
(58) Field of Search ..... 396/567–570, 396/639; 355/27–29, 77; 430/398–400, 434, 438; 134/64 R, 64 P, 122 P

(56) References Cited

U.S. PATENT DOCUMENTS

| | | | |
|---|---|---|---|
| 3,869,288 A | 3/1975 | Godowsky | 430/376 |
| 5,200,302 A | 4/1993 | Iwano | 430/383 |
| 5,701,541 A | 12/1997 | Ueda et al. | 396/569 |

*Primary Examiner*—D Rutledge
(74) *Attorney, Agent, or Firm*—Milton S. Sales

(57) ABSTRACT

The present invention provides a method and a system for processing light sensitive photographic material, comprising the steps of exposing an image onto the photographic material, applying to the material in an imagewise manner at least one developer wherein the amount of developer applied at any point depends on the image density to be produced at that point, wherein the exposure is controlled to account for the response of the photographic material to the amount of developer applied. The invention provides a method and system for processing photographic material that is simple, chemically efficient and produces low or zero-effluent whilst also providing fully satisfactory photographic performance.

22 Claims, 7 Drawing Sheets

METHOD OF PROCESSING PHOTOGRAPHIC MATERIAL

FIELD OF THE INVENTION

This invention relates to a method of processing photographic material and to the production of images from film or digital image files. For example, the invention includes the production of photographic print images using a photographic material such as Ektacolor™ Paper. It is concerned particularly with processing using a development stage in which development is carried out with developer applied to the surface of the processed material in an imagewise manner. The invention also relates to a method of determining a required exposure for producing the image.

BACKGROUND OF THE INVENTION

Photographic prints are typically made using materials, which are exposed imagewise and processed through a set of chemical processing solutions. Processing of photographic materials in automatic processing equipment is normally carried out using tanks of solution through which the processed material is passed. The solutions are modified as they carry out the chemical processes. The effect of this modification is compensated for by replenishment of the tanks with replenisher solutions, which add chemicals to replace those that have been used during processing. Care has to be taken to replenish tank solutions accurately so that the chemical concentrations are maintained at a constant level to ensure consistent performance.

Solution is lost from the tanks when the processed photographic material leaves the tank. Also, the replenisher solutions are added to the tanks in larger quantities than are removed with the processed material thus producing liquid effluent. Chemical by-products introduced by the chemical reactions occurring during processing are removed from the tank by the liquid effluent and also by the solution that is carried out of the tank with the processed material.

Single-Use processing systems involving the use of small volumes of processing solution have been described (see for example Research Disclosure Sep. 1997, p638 ). In some examples, these involve the application of processing solutions to the surface of the photographic materials in a way that results in a uniform amount of solution being applied i.e. when the material is being developed, a layer of uniform thickness of developer is applied over the material. The uniform application of developer to the surface of color negative paper using ink-jet methods has been described in, for example, European Patent Application No. 94201050.5. U.S. Pat. No. 3,869,288 describes the separate application of developer components by spraying droplets onto the surface of the photographic material being processed. U.S. Pat. No. 5,200,302 describes a method of processing involving coating photographic material with developer to produce a film of processing solution of a thickness at most 20 times that of the dry gel thickness of the material.

A problem with uniform application of processing solution, such as developer, is that this results in low-density areas of the image being treated with the same amount of chemical as maximum density areas. This results in inefficient chemical use and possibly to the production of higher than required image density in minimum density areas.

To address this, image information is used to control the amount of processing solution applied so that it is applied in an imagewise manner, as described in, for example, U.S. Pat. No. 5,701,541. In this example, high silver papers are used and processed involving bleaching and fixing to remove silver and silver halide followed by washing to remove all the soluble chemicals left in the coating including developing agent from the developer and the dissolved silver halide.

Imagewise application of developer also enables easier removal of the materials dissolved in the solution from the coating of the photographic material such as color developing agent. This is because, in addition to less excess developer being used in total, the excess is normally greater in low density areas where less is used in the formation of image density and where the removal of all the developer components is more important. This is significant when the development is carried out using coating or spraying rather than a deep tank method since the concentrations of processing solution are usually higher. It is also particularly important when the stages after development are short or involve low rates of replenishment which may lead to unacceptable build-up of developer components. In some examples, silver removal stages are omitted altogether in which case there is no opportunity to remove or redistribute the developer applied in the developer stage.

In addition, where uniform application of developer is used the response of the photographic material to the image exposure (resulting in image dye formation), is known. However, when the amount of solution, or the composition of the solution or solutions applied varies according to the image, the response of the photographic material to the image exposure also varies. Where less dye is needed, less solution needs to be provided but then the rate and extent of dye formation is reduced. As a result, the process itself reduces the image density in these areas, which is undesirable. In such a situation, it is likely that compared with a process using uniform application of processing solution the image resulting from an imagewise application of solution is higher in contrast, which is clearly undesirable.

Problem to be Solved by the Invention

A system and method is required to provide the advantages of a simple, chemically efficient, low or zero-effluent process with fully satisfactory photographic performance.

It is further desirable to provide a method of stabilizing the image against long-term modification by retained chemicals which involves minimal washing or other means of removal of retained chemicals.

Reducing the amount of developer applied, according to the anticipated density required can result in reduced response to the image exposure during the development process. This can increase the contrast of the image and if too little developer is applied can even result in loss of image information in low density regions. Both effects are clearly undesirable. It is therefore necessary to find a way to provide high quality images using a process involving image-wise developer application and benefiting from process simplicity, efficient use of process chemicals and low levels of effluent.

SUMMARY OF THE INVENTION

According to a first aspect of the present invention, there is provided a method for processing light sensitive photographic material, in which an image is exposed onto the photographic material. At least one developer is applied to the material in an imagewise manner wherein the amount of developer applied at any point depends on the image density to be produced at that point. The exposure is controlled to account for the response of the photographic material to the amount of developer applied.

Preferably, the exposure is controlled such that the combination of exposure and the amount of developer applied produces a predetermined image density at that point. In one example, the predetermined image density is substantially equivalent to that produced by processing of an exposed image in a non-imagewise manner.

Preferably, the exposure is controlled using digitally controlled scanning of the image onto the photographic material. Alternatively, a mask, which may be digitally generated, is used to control the exposure.

Preferably, the developer is applied to the photographic material using a fluid-jet applicator.

According to a second aspect of the present invention, there is provided a method of determining a required exposure for creating an image on photographic material in accordance with the method of the first aspect of the present invention. Initially, a value of exposure on a desired sensitometry relationship for a non-imagewise development process is selected.

As a second step the value of image density to which the selected value of exposure corresponds is identified. Finally, from a sensitometry relationship for an imagewise development process, a value of exposure is identified which provides the same image density as that obtained in the second step described above.

According to a third aspect of the present invention, there is provided a photographic processing system, comprising a processor unit to receive image information relating to an image to be printed and an exposure device to expose the image onto photographic material.

The system also comprises a developer applicator to apply developer to the photographic material in an imagewise manner. The processor unit is coupled to the exposure device to control the exposure so as to account for the response of the photographic material to the amount of developer applied.

Preferably, the system further comprises a scanner to scan film containing an image and to provide image information to the processing unit. The image information provided to the processor unit may be obtained from a digital image.

In a preferred example, the exposure is controlled by an optical mask to control the intensity of light incident onto the photographic material.

Preferably, the photographic material is selected from the group consisting of, amongst others, photographic paper, translucent film, transparent film and reflection print materials. Preferably, the developer applicator is a fluid-jet applicator.

Advantageous Effect of the Invention

The control of the exposure device may include a modification to the exposure, calculated using a calibration procedure which compares the response of the material to uniform and non-uniform application of developer. For each exposure level which is appropriate for a uniform process and thus produces the required image density, a calculated change in exposure is provided so that the same required image density is produced with the non-uniform process.

The invention provides a method of imagewise development of photographic material that is simple, chemically efficient and produces low or zero-effluent whilst also providing fully satisfactory photographic performance. The exposure of light to the photographic material is controlled so that in combination with the controlled application of developer, the contrast of the produced image is acceptable and comparable to that of an image produced using non-imagewise development.

The amount of developer used in the development process is determined in accordance with the image density required such that less color developer is wasted and less remains in the photographic material after development. In addition, as mentioned above, the amount of liquid effluent from washing can be reduced.

The invention also provides a method of determining a required exposure of the photographic material such that the image density of the image produced is equivalent to that produced by exposure followed by development in a non-imagewise manner. The method relies on mapping values of image density on a desired sensitometry relationship to corresponding values of image density on the sensitometry relationship for an imagewise development and creating a look-up table of values for exposure required for creating an image on photographic material by imagewise development. Therefore, by selection of an appropriate desired sensitometry relationship the image density of the final image can be accurately controlled.

Means used for removing (without washing) retained chemicals, particularly developing agent, can have limited capacity. It is wasteful to provide any more capability for such removal, e.g. coated carbon or chemical destruction, than is necessary. The efficiency of use of development chemistry and removal means is much improved by the use of imagewise developer application.

BRIEF DESCRIPTION OF THE DRAWINGS

Examples of the present invention will now be described in detail with reference to the accompanying drawings, in which.

DETAILED DESCRIPTION OF THE INVENTION

Figure 1:
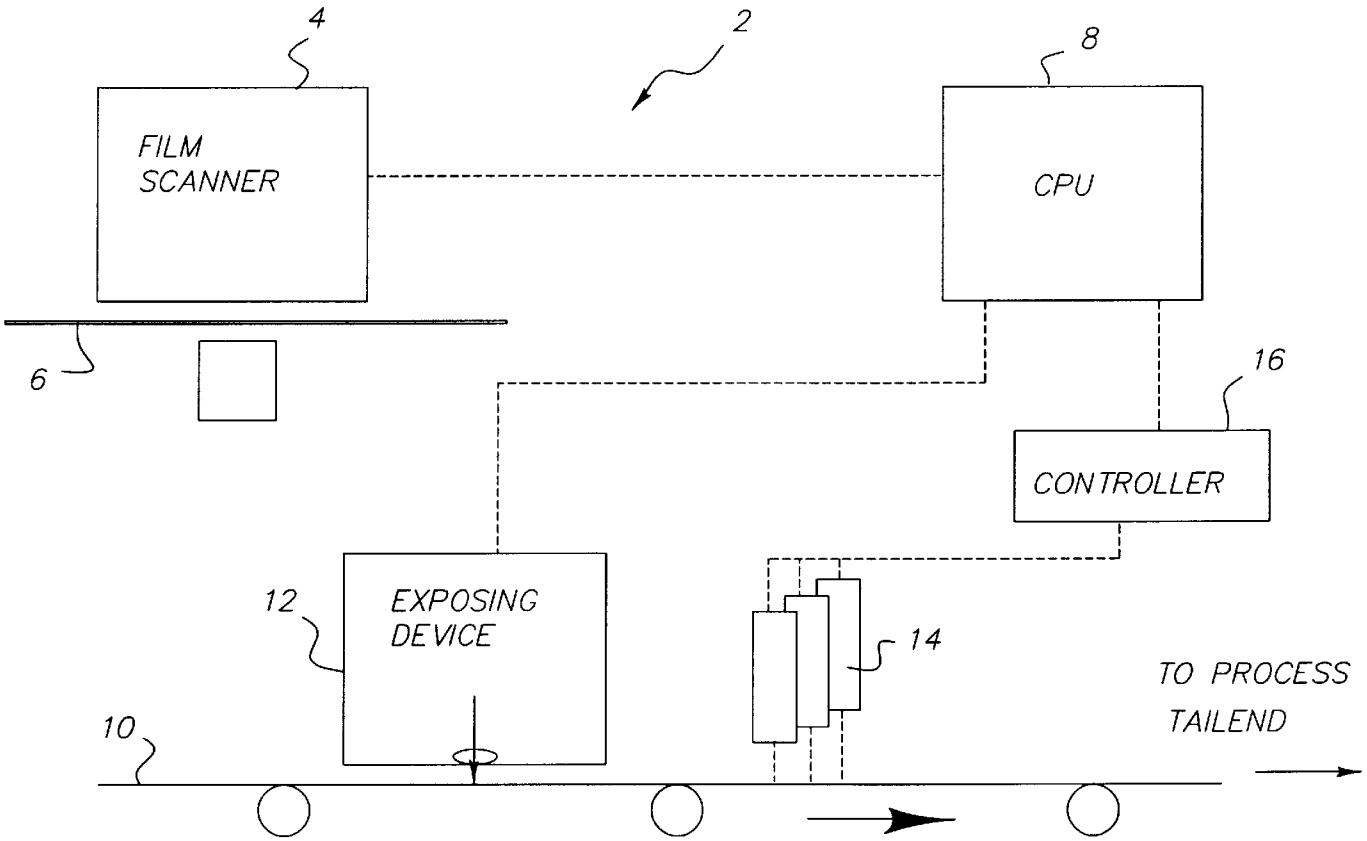
FIG. 1 shows an example of a processing system according to the present invention.

FIG. 1 shows an example of a processing system according to the present invention. The system 2 has a film scanner 4 arranged to receive and scan processed film 6. Information about an image on the processed film 6 is read by the scanner 4 and coupled to a central processing unit (CPU) 8. The system also includes an exposing device 12 and a single or multi-part developer application station 14, both coupled to the CPU 8. Information about the image is provided to the exposing device 12 from the CPU 8. The developer application station 14 is controlled to apply developer to photographic paper 10 in an imagewise manner after the image has been exposed to the paper by exposing device 12. The application station 14 receives information from a controller 16 connected between the station 14 and the CPU 8. The application station 14 may include a fluid-jet system functioning as an applicator for the developer.

The ratio ($D_{max}$:$D_{min}$) between developer laid down by station 14 in maximum density ($D_{max}$) areas to developer laid down in minimum density ($D_{min}$) areas must be large enough such that the amount of developer in $D_{min}$ areas is sufficient to detect any latent image thereby ensuring that image information is not lost. A value fort $D_{max}$:$D_{min}$ between 20:1 and 1.5:1 is preferable. More preferably, a value for the ratio is between 8:1 and 3:1. Most preferably, the ratio is 4:1 since this ensures that the latent image is detected in low density areas whilst also allowing approximately a 50% reduction in the amount of developer used in comparison to systems that rely on uniform imagewise application of the developer.

If the image to be created on the photographic paper 10 is obtained from a digital camera, there is no requirement for a scanner 4, since image information is directly obtainable from the digital camera.

In use, photographic material such as processed film is fed into the processing system 2, where it is scanned by scanner 4 to obtain an image density map of an image being processed. The CPU 8 is operative to receive image density information from the scanner 4 and, using a pre-calculated look-up table, control the exposing device 12 and the developer application station 14. The amount of exposure and the amount of developer applied to each point of the photographic paper 10 is controlled such that a predetermined image density is achieved at that point As explained above, when the amount of developer or the composition of the solution or solutions applied to the photographic paper, varies in an imagewise manner, the relationship between exposure and final image density alters. Compared with a process with uniform application of processing solution the image resulting from an imagewise application of developer is higher in contrast, which is clearly undesirable. In particular, reducing the amounts of developer applied in low-density areas can result in the latent image not being detected.

The present invention overcomes this problem by controlling the exposure applied to the photographic paper 10 to compensate for any such effect. The exposure control can be implemented using, for example, a cathode-ray tube (CRT) or a laser writing engine. Alternatively, the exposure can be controlled using digitally controlled scanning or a digitally generated mask may be used to modify the optical exposure provided by the exposing device 12.

In one example of the present invention, the exposure of the image on the photographic paper is controlled such that when the image is developed using imagewise application of developer, the image density of the developed image is the same as would have been obtained had the image have been developed by conventional deep tank processing. In particular, by controlling the exposure it is possible to ensure that the contrast of the image produced is the same as if the image were produced by conventional means. However, the amount of developer used is substantially reduced and it is possible that virtually no effluent is produced.

In the present example, once an image has been detected by the scanner 4, exposure provided to the photographic paper 10 is controlled in accordance both with image information obtained by the scanner and with the amount of developer applied by the developer application station 14. It will be appreciated that the photographic paper 10 is an example of a light sensitive photographic material suitable for use in the present invention. Other examples of suitable materials include transparent or translucent film materials including color negative films and reversal films used either to produce the final viewed image or intermediate images to be used in further photographic stages.

Alternatively, an indirect source of image information may be used. For example, image information may be obtained from a digitally stored image on a hard disk or CD-ROM, the digitally stored image being obtained from a previous scan. In another example, image information may be obtained from a low-resolution image stored on a magnetic coating on the film. The low-resolution image may be derived from a digital image captured at the same time as a conventional photographic film image.

Figures 2A, 2B:
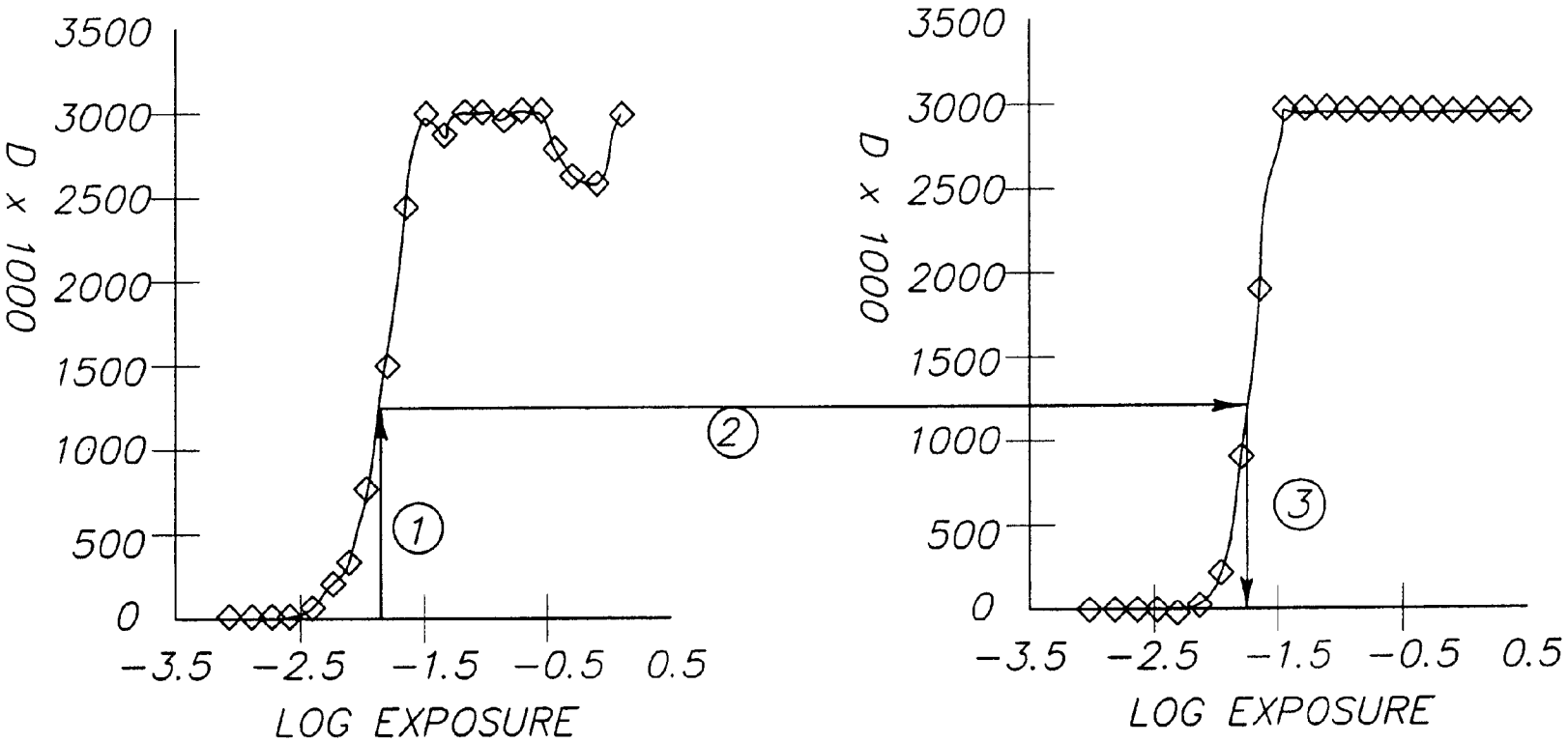
FIGS. 2A and 2B show a schematic example of sensitometric relationships used to calculate exposure in an example of the method of the present invention.

Control of the applied exposure is achieved using the graphs shown in FIGS. 2A and 2B. Initially, an aim sensitometry is determined as shown in FIG. 2A, perhaps from a deep tank process or any other process the sensitometry of which it is desired to simulate. The sensitometry of the imagewise development (FIG. 2B) is also determined by a suitable method, such as calculation using a sensitometric model, as explained below or by experiment. The exposure that the material has to experience to produce densities equivalent to the conventionally processed material is then derivable using interpolation between the relationships of FIGS. 2A and 2B.

This process is shown diagrammatically in FIGS. 2A and 2B. For an exposure on the aim sensitometric curve, the density that this will produce is determined as shown in step 1. This density is mapped onto the sensitometric curve of FIG. 2B, as shown in step 2. From this density, the exposure required to give this density by the imagewise process, (step 3 of FIG. 2B) can be determined. This process is repeated for a number of exposures on the aim sensitometric curve and so the required exposure can be determined and a look up table produced (see FIG. 7). From the look up table, the required exposure of the imagewise development process that gives the same density as the aim process can be determined. This is repeated for all three colors.

This can be practiced with a real picture exposure by passing the exposure that would be used with an aim material through the lookup table. For each value of exposure passed through the table, a value of required exposure of the imagewise development process that gives the same density as the aim process is determined. These values of required exposure, obtained from the lookup table, are used to expose the print.

The sensitometric curve for a process such as imagewise development as shown in FIG. 2B, can be determined from conventional deep tank process results by using a model that incorporates the effect of, for example, exposure, component concentrations, temperature and process time. A process that might be used to do this, for a system in which low silver paper is used which requires oxidizing agents in the developer/amplifier or amplifier solutions (known as an RX process) will now be described.

Figure 3:
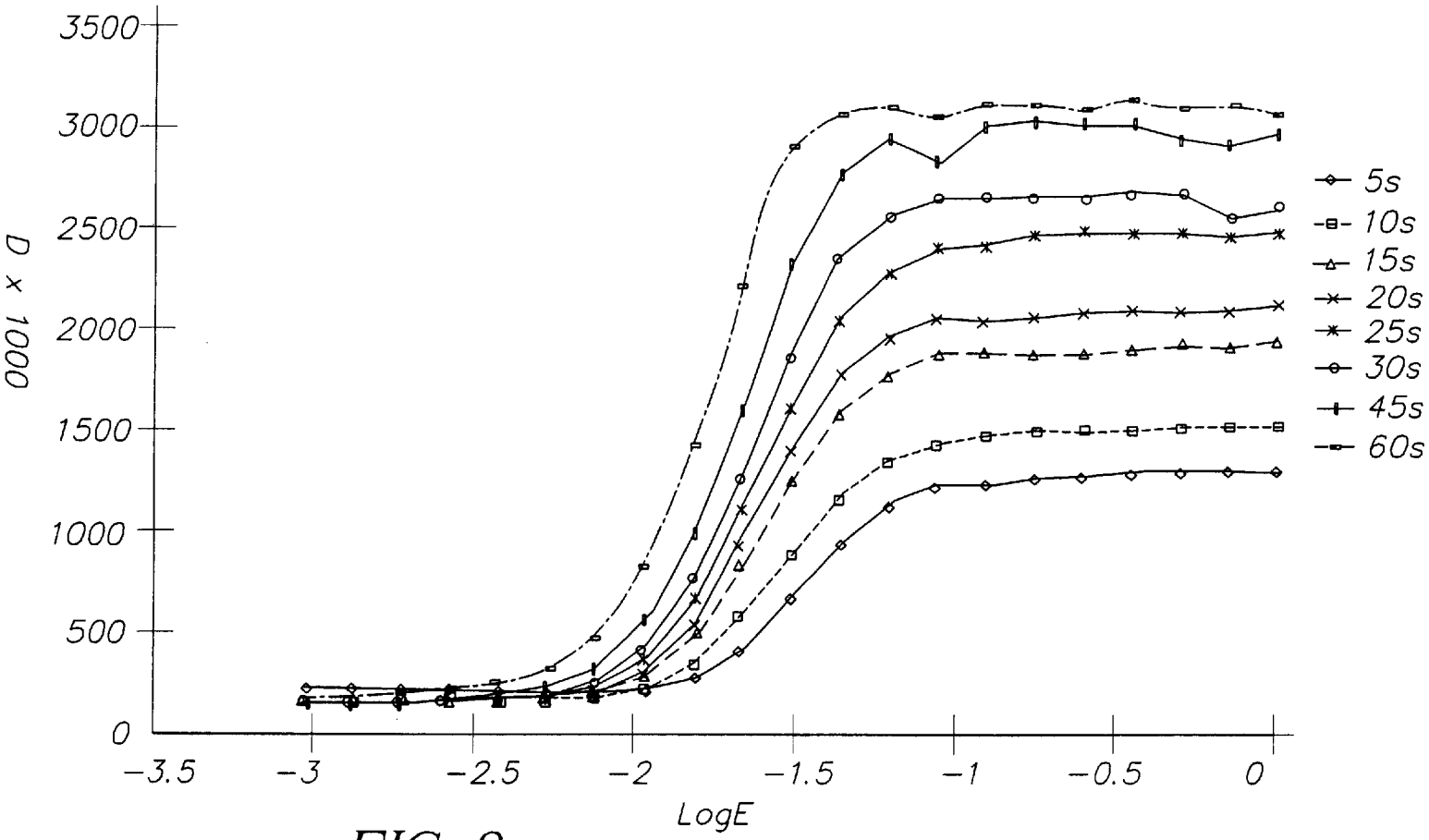
FIGS. 3 to 6 are graphs used to calculate exposure in an example of the method of the present invention.
Figure 4:
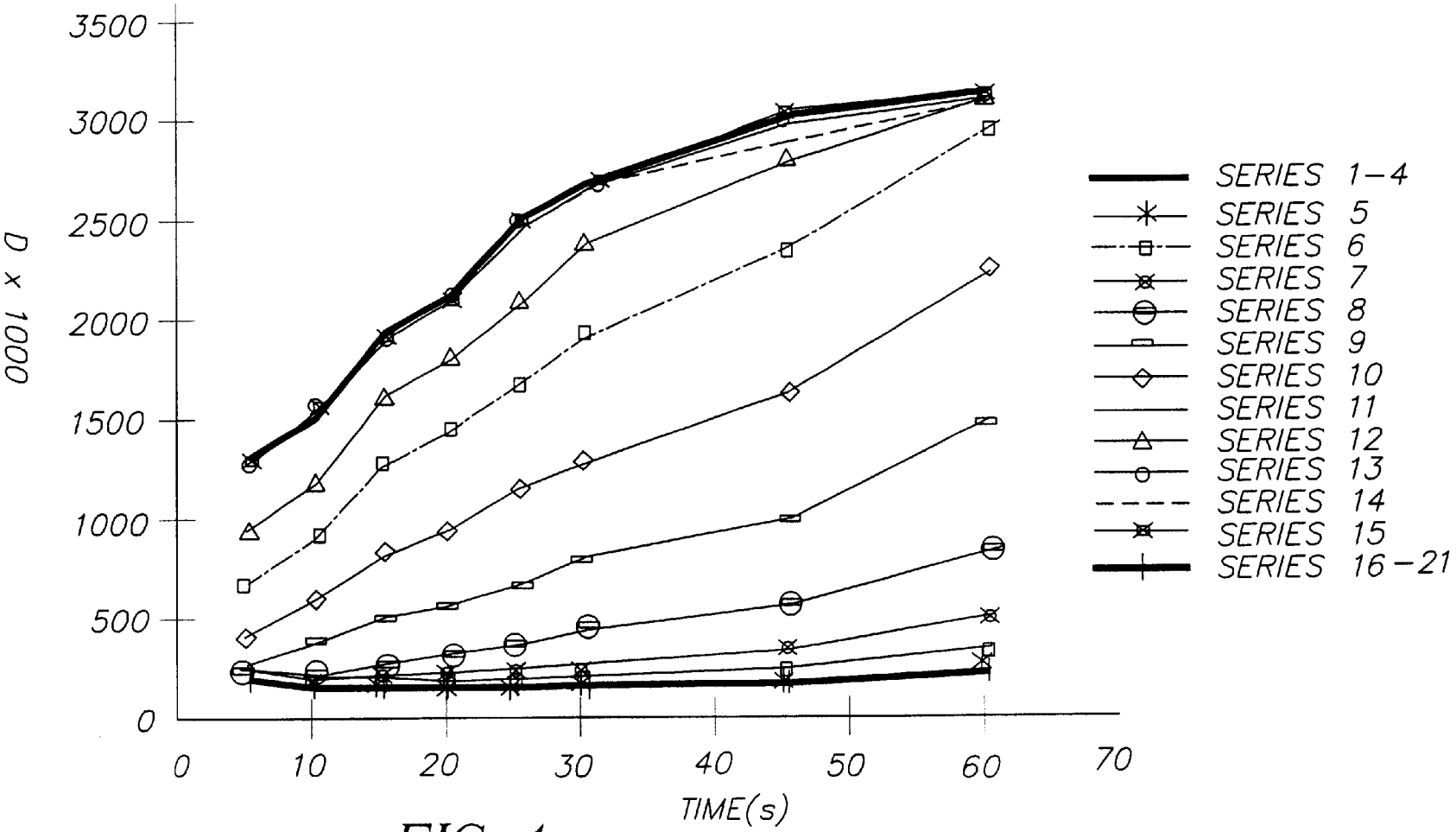

Initially, conventional processing (such as deep tank processing) is carried out with a single developer for a number of development times for material that has been exposed to a step wedge. The sensitometry for those times is determined and is shown as a set of curves in FIG. 3. Each curve in FIG. 3 represents the sensitometric relationship between Log(exposure) and image density for the material at a fixed development time. From these curves, for each of 21 values of constant exposure (Log(exposure)) a density/development time series is determined, as shown in FIG. 4. Each series in FIG. 4 is made up of an input from each of the curves shown in FIG. 3 for a constant value of Log (exposure). Series 1 in FIG. 4 is made up of image density values obtained from each of the curves of FIG. 3 for a Log(exposure) value of approximately−3. Series 21 in FIG. 4 is made. up of image density values obtained from each of the curves of FIG. 3 for a Log(exposure) value of 0. Next, a rate equation is determined for each exposure step that adequately describes the shape of each of the density/development time series of FIG. 4, with sufficient accuracy for the purpose.

As will be explained below, these steps are then repeated with different concentrations of components (variable components) in the developer, preferably using a statistically designed experiment such as that described by "Statistics for Experiments", Box GEP, Hunter W. G. and Hunter J. J. published by Wiley-Science, 1978. Once this has been done, a model is determined that expresses the terms in the rate model in terms of the variable components in the developer. The component model is then used to determine the density/development time curves for each exposure step under the new conditions by integrating the rate model with respect to changing concentration in the rate equation according to the component models using some suitable method e.g., Runge-Kutta integration.

At the process time of interest, the densities of interest at each exposure step are collected to obtain a new, modeled sensitometry. A graph of the data can be plotted, as shown in FIG. 2B, and used to obtain the exposure transform from an aim sensitometry, like the one shown in FIG. 2A, in the way described above.

The above method can be explained by using an example of the red layer in and RX processed low silver paper.

The developer/amplifier formulation was as follows

| | |
|---|---|
| Anti-Cal #5 | 0.6 g |
| Anti-Cal #8 | 2.0 g |
| Dipotassium hydrogen phosphate.$3H_2O$ | 40.0 g |
| Hydroxylamine sulphate | 0.5 g |
| CD3 | x g |
| KCl | z g |
| Water to | 1 litre |
| pH adjusted to 11.7 with sodium hydroxide | |

where x, y and z were varied according to a designed experiment set out in the following table:

TABLE 1

| ID | z | X | Y |
|---|---|---|---|
| 1 | 0.5 | 2.5 | 10 |
| 2 | 0.5 | 2.5 | 30 |
| 3 | 0.5 | 6.75 | 10 |
| 4 | 0.5 | 6.75 | 30 |
| 5 | 0.5 | 4.5 | 20 |
| 6 | 0.5 | 1 | 20 |
| 8 | 0.5 | 4.5 | 50 |
| 9 | 0.5 | 10 | 50 |
| 505 | 0.5 | 4.5 | 20 |
| 525 | 1.5 | 4.5 | 20 |
| 530 | 3 | 4.5 | 20 |

A low silver photographic paper containing a total of 82 mg/$m^2$ silver with a chloride content of at least 95%, was exposed through a step wedge to light for 1/10s with filters to give approximately neutral patches when processed. The following process was used:

| | | |
|---|---|---|
| Develop/amplify | 10, 15, 20, 25, 30, 35, 50 or 65 | 40° C. |
| Stop (5% acetic acid) | 30s | 40° C. |
| Wash | 90s | 40° C. |
| Dry | room temperature | |

No attempt was made to remove the small amount of silver and silver halide left within the paper.

The strips were read with an automatic densitometer with densities corrected for status A filters.

As an example of the data obtained FIG. 3 shows the results at different developer/amplifier for the red of the neutral of ID 5. From these data a time versus density plot is constructed as shown in FIG. 4.

Figure 5:
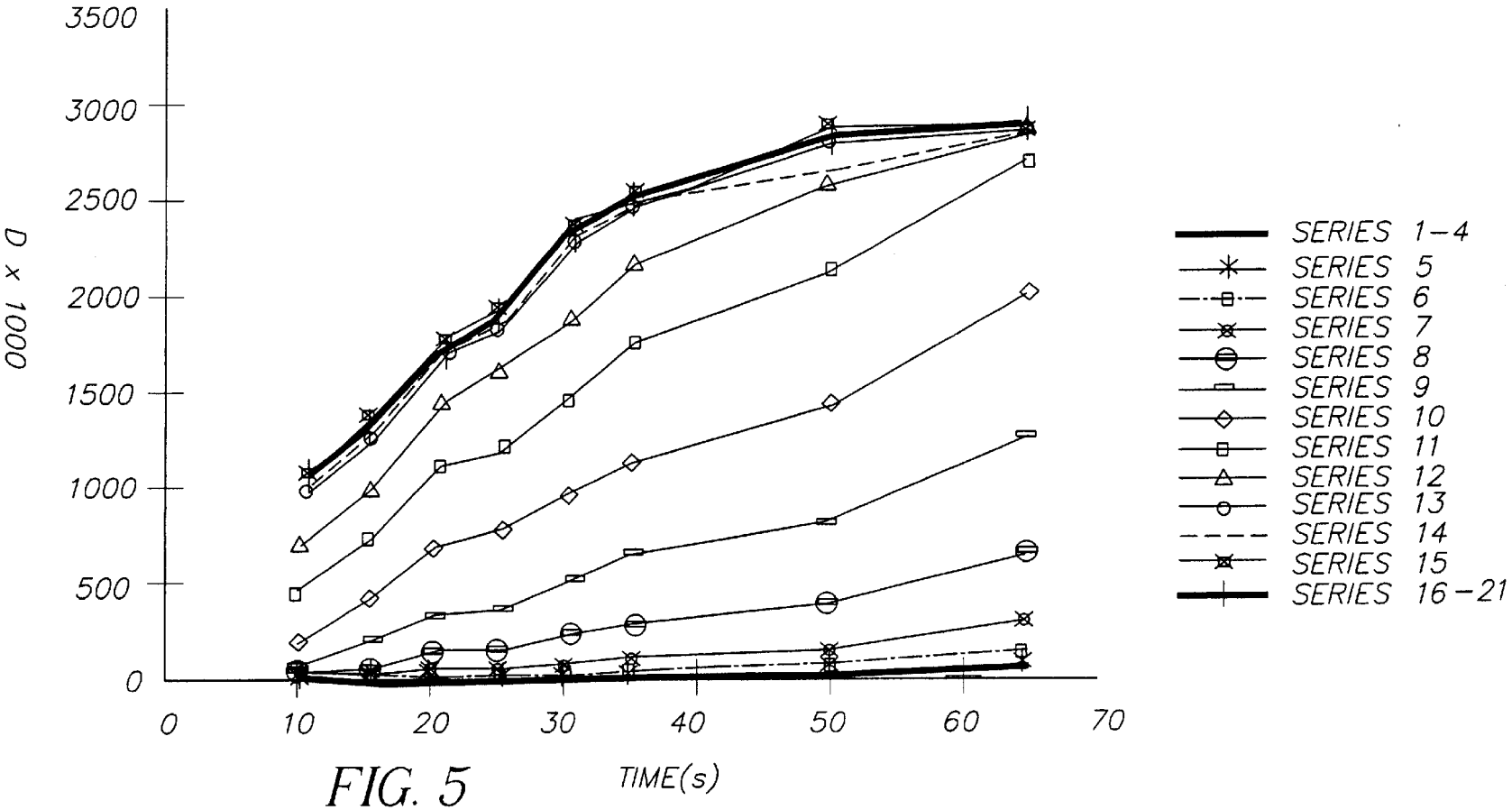

To fit a model the $D_{min}$ was removed from the results but stored for later curve correction, as this was also dependent on the developer/amplifier composition, as shown in FIG. 5.

Figure 6:
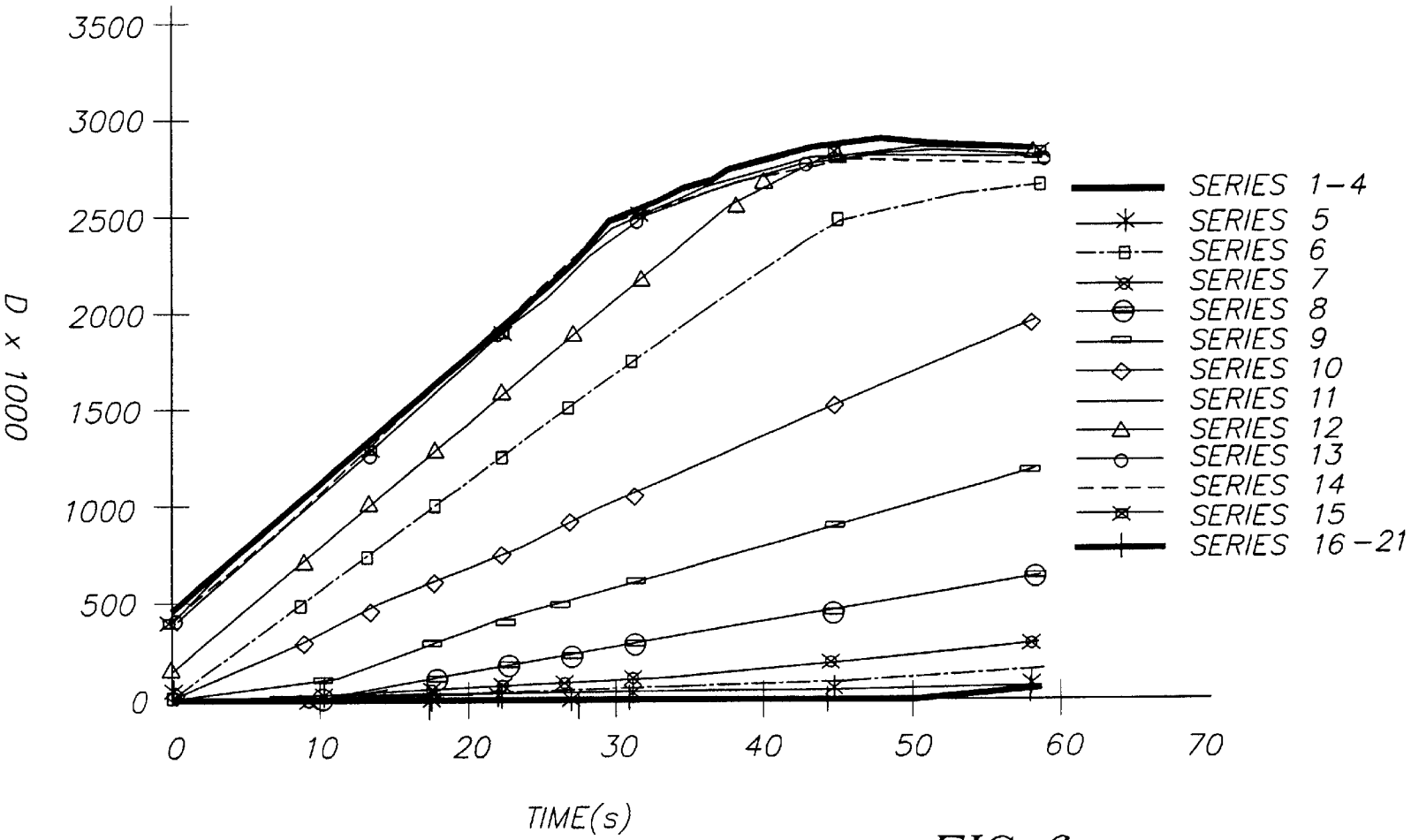

An estimated linear model was fitted to the data, which was of the form $$\text{If } D<D_{max},\ D=k(t-t_{ind})$$

$$\text{If } D>=D_{max},\ D=D_{max}$$

where $D_{max}$, t and $t_{ind}$ (an apparent induction period which could be negative) were the variables varied when using a least squares comparison of model with the real data. The plots of the best fit models are shown in FIG. 6.

A collection of values for k, $t_{ind}$ and $D_{max}$ was made for each step and each developer constitution. It was found that one $D_{max}$ would suffice to describe the $D_{max}$ obtained for each particular developer. The $D_{max}$s could be described by one empirical model. Using this $D_{max}$, the ks and $t_{ind}$s were redetermined. For each step an empirical model that described k and tind in terms of the concentrations of color developing agent and hydrogen peroxide concentration were found using suitable statistics software. Eventually 21 models were obtained for k and $t_{ind}$ that described the behavior with respect to color developer, hydrogen peroxide and potassium chloride concentration of the form $$k=a_k+b_k[CD]+c_k[H_2O_2]+d_k[KCl]+e_k[CD][H2O_2]$$

$$t_{ind}=a_t+b_t[CD]+c_t[H_2O_2]+d_t[KCl]+e_t[CD][H2O_2]$$

The values for k for the red layer are shown in Table 2. Values were obtained for the other colors and for $t_{ind}$ in a similar form.

TABLE 2

| Step | $a_k$ | $b_k$ | $c_k$ | $d_k$ | $e_k$ |
|---|---|---|---|---|---|
| 3 | −2.9800 | 0.4360 | 0.1180 | 0.9420 | −0.0110 |
| 4 | −3.1992 | 0.7388 | 0.1666 | 0.4801 | −0.0190 |
| 5 | −2.5067 | 0.9150 | 0.1536 | −0.6556 | −0.0210 |
| 6 | −2.3067 | 0.8639 | 0.1671 | −0.7427 | −0.0172 |
| 7 | −2.0687 | 1.1140 | 0.1986 | −1.1428 | −0.0108 |
| 8 | −1.1645 | 1.5884 | 0.2880 | −1.9237 | −0.0026 |
| 9 | 0.6283 | 1.9167 | 0.5017 | −2.8777 | 0.0045 |
| 10 | −7.2298 | 3.5229 | 1.2015 | −4.3497 | −0.0242 |
| 11 | −16.2726 | 5.7611 | 2.0594 | −6.0753 | −0.0745 |
| 12 | −25.0000 | 11.6303 | 2.3000 | −10.3672 | −0.1704 |
| 13 | −26.0000 | 10.0573 | 2.7000 | −10.7962 | −0.1274 |
| 14 | −28.1185 | 11.0146 | 2.9098 | −12.2732 | −0.1972 |
| 15 | −26.2607 | 9.5381 | 2.7870 | −11.4433 | −0.1683 |
| 16 | −28.0000 | 9.7090 | 2.8511 | −13.6270 | −0.1944 |
| 17 | −29.5000 | 11.7586 | 3.3942 | −13.7902 | −0.3029 |
| 18 | −30.5000 | 12.1374 | 3.3783 | −14.6764 | −0.2822 |
| 19 | −31.9064 | 11.3266 | 2.9910 | −16.1500 | −0.2288 |
| 20 | −30.6776 | 10.5079 | 2.9646 | −15.8334 | −0.2129 |
| 21 | −37.1758 | 10.3083 | 3.4129 | −15.4862 | −0.2466 |

From these models and the rate equation it was possible to determine the rate of production of dye at any step with any developer with known concentration of color developing agent, hydrogen peroxide or potassium chloride concentration. Furthermore, it was possible to predict the rate of formation of dye from a system where the component concentrations were changing with time as in the case when developer is applied to the surface of the paper in some particular way such as by spraying where the developing agent and hydrogen peroxide concentrations deplete during the reaction and the chloride concentration increases. The application may be equally over the surface or in some way as a function of the original exposure.

This was done by solving the equation $$\int_{Dmin}^{D} D = \int_{tind}^{t} k dt$$

numerically for each step and where k is a function of the remaining chemical concentrations in the layer. These might be determined stoichiometrically for instance by assuming that density was proportional to the amount of color developing agent and peroxide used and potassium chloride gained, i.e., $$[CD]=[CD_{initial}]-u_{CD}.D$$

$$[H_2O_2]=[H2O2_{initial}]-u_{H2O2}.D$$

$$[KCl]=[KCl_{initial}]+u_{KCl}.D$$

A suitable method for doing this is to use a Runge-Kutta method which is described in "The Numerical Solution of Ordinary and Partial Differential Equations", G. Sewell, pub. Academic Press, p 56 ff This can be programmed as a macro in Excel or other suitable spreadsheet or using a purpose written routine or commercially available software.

Using this method two curves were calculated; a standard process in a deep tank, i.e. with constant concentration of developer components x=5, y=20, z=0.5 and developer that was applied imagewise to surface of some paper a 20 ml/m2 and initially $x=5+25.D_{expected/Dmax}$, $y=10+50.D_{expected/Dmax}$, z=0.5 (no significant change expected).

The resultant curves are those shown and described above with reference to FIGS. 2A and 2B. From this, a transform is calculated from one exposure scale, e.g., the conventionally processed RX material to one that has been processed using imagewise application of developer. An example of the red scale exposure transform obtained with the above example is shown in FIG. 7.

Figure 7:
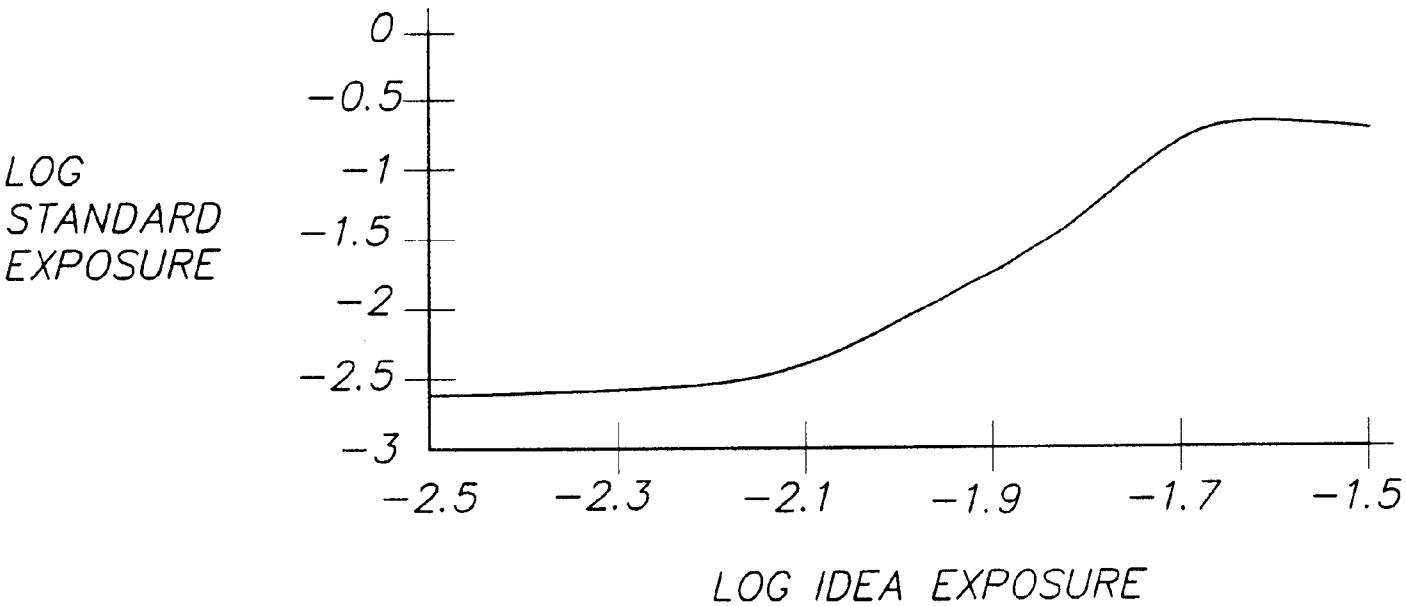
FIG. 7 is a relationship between desired and required exposure used in the method of the present invention.

In the method of the present invention, the transform shown in FIG. 7 is used as a look-up table by the CPU 8 of the processing system to determine a required exposure that must be used on the photographic paper 10 if, when the paper is developed using imagewise development, the image density at each point is to be the same as would be obtained from a conventional photographic processing system.

What is claimed is:

1. A method for processing light sensitive photographic material, comprising the steps of:

exposing an image onto the photographic material; and applying to the material in an imagewise manner at least one developer wherein the amount of developer applied at any point depends on the image density to be produced at that point;

wherein the exposure is controlled to account for the response of the photographic material to the amount of developer applied.

2. A method according to claim 1, in which the exposure is controlled such that the combination of exposure and the amount of developer applied produces a predetermined image density at that point.

3. A method according to claim 2, in which the predetermined image density is substantially equivalent to that produced by processing of an exposed image in a non-imagewise manner.

4. A method according to claim 1, in which the exposure is controlled using digitally controlled scanning of the image onto the photographic material.

5. A method according to claim 1, in which a mask is used to control the exposure.

6. A method according to claim 5, in which the mask is digitally generated.

7. A method according to claim 1, in which the exposure is controlled by exposing the image by a first amount of exposure calculated to produce a predetermined image density for a corresponding amount of developer applied.

8. A method according to claim 7, in which the calculated exposure is stored in a look-up table, the look-up table including a first set of values of exposure from a desired sensitometry relationship for a non-imagewise development process and a second set of values of exposure from a sensitometry relationship for an imagewise development process, wherein for each value in the first set of values there is a corresponding value in the second set of values, each of the two values providing a substantially identical image density when the photographic material is developed.

9. A method according to claim 8, in which the imagewise development is performed in accordance with a predetermined ratio of developer application between maximum image density areas and minimum image density areas of the image to be produced.

10. A method according to claim 9, wherein the ratio of developer application between maximum image density areas and minimum image density areas of the image to be produced is between 20:1 and 1.5:1.

11. A method according to claim 10, wherein the ratio of developer application between maximum image density areas and minimum image density areas of the image to be produced is between 8:1 and 3:1.

12. A method according to claim 10, wherein the ratio of developer application between maximum image density areas and minimum image density areas of the image to be produced is 4:1.

13. A method according to claim 1, in which the photographic material is selected from the group consisting of photographic paper, translucent film, transparent film and reflection print materials.

14. A method according to claim 1, in which the at least one developer applied is applied using a fluid-jet applicator.

15. A method of determining a required exposure for creating an image on photographic material in accordance with the method of claim 1, comprising the steps of:

(a) selecting a value of exposure on a desired sensitometry relationship for a non-imagewise development process;

(b) identifying the value of image density to which said selected value of exposure corresponds; and (c) from a sensitometry relationship for an imagewise development process, identifying a value of exposure which provides the same image density as obtained in step (b).

16. A method according to claim 15, further comprising the step of:

repeating steps (a) to (c) for a plurality of different values of exposure on the desired sensitometry relationship, and storing the obtained values from step (c) in a look-up table.

17. A photographic processing system, comprising:

a processor unit to receive image information relating to an image to be printed;

an exposure device to expose said image onto photographic material; and a developer applicator to apply developer to the photographic material in an imagewise manner, wherein the processor unit is arranged to control the exposure so as to account for the response of the photographic material to the amount of developer applied.

18. A system according to claim 17, further comprising a scanner to scan film containing an image and to provide image information to the processing unit.

19. A system according to claim 17, wherein the exposure is controlled by an optical mask to control the intensity of light incident onto the photographic material.

20. A system according to claim 17, wherein the image information provided to the processor unit is obtained from a digital image.

21. A system according to claim 17, in which the photographic material is selected from the group consisting of photographic paper, translucent film, transparent film and reflection print materials.

22. A system according to claim 17, in which the developer applicator is a fluid-jet applicator.

* * * * *